US005077974A

United States Patent [19]

Kamikawa et al.

[11] Patent Number: 5,077,974

[45] Date of Patent: Jan. 7, 1992

[54] CONSTANT POWER DISPLACEMENT CONTROL CUTOFF SYSTEM WITH ADJUSTABLE RELIEF VALVE

[75] Inventors: Nobuhisa Kamikawa, Neyagawa; Kimio Nishida, Hirakata, both of Japan

[73] Assignee: Kabushiki Kaisha Komatsu Setsakusho, Japan

[21] Appl. No.: 425,207

[22] PCT Filed: Feb. 13, 1989

[86] PCT No.: PCT/JP89/00140

§ 371 Date: Sep. 7, 1989

§ 102(e) Date: Sep. 7, 1989

[87] PCT Pub. No.: WO89/08190

PCT Pub. Date: Sep. 8, 1989

[30] Foreign Application Priority Data

Feb. 25, 1988 [JP] Japan ..... 63-42904

[51] Int. Cl.[5] ..... F04B 49/00; F15B 11/00

[52] U.S. Cl. ..... 60/452; 60/468

[58] Field of Search ..... 60/443, 444, 447, 449, 60/452, 464, 468, 494

[56] References Cited

U.S. PATENT DOCUMENTS 3,635,021 1/1972 McMillen et al. ..... 60/468 X
4,405,287 9/1983 Kuchenbecker et al. ..... 60/447 X
4,481,770 11/1984 Lohbauer et al. ..... 60/468 X
4,548,036 10/1985 Matsuda et al. ..... 60/464
4,571,941 2/1986 Aoyagi et al. ..... 60/444 X

FOREIGN PATENT DOCUMENTS 184749 11/1982 Japan ..... 60/444
60-250132 12/1985 Japan .
61-93552 6/1986 Japan .
62-56801 4/1987 Japan .
62-167880 10/1987 Japan .

*Primary Examiner*—Edward K. Look
*Assistant Examiner*—George Kapsalas
*Attorney, Agent, or Firm*—Richards, Medlock & Andrews

[57] ABSTRACT

Disclosed is a hydraulic control system mounted in a hydraulic circuit of a hydraulic excavator and adapted to increase the relief hydraulic pressure and the flow rate. In accordance with one aspect of the invention, a hydraulic control system for a hydraulic excavator having power constant control and cut-off control comprises: a variable relief valve (60) for increasing the pressure upon receipt of a pilot signal (Pc7), a solenoid valve (80) for connecting or disconnecting the pilot signal (Pc7), a variable cut-off control valve 10A which, upon receipt of a pilot signal (Pc6), cancels the cut-off control, a solenoid valve (70) for connecting or disconnecting the pilot signal (Pc6) and an electric circuit (X01) in which a switch (90) for opening or closing the solenoid valves (70, 80) is provided. In accordance with a second aspect of the invention, a timer is provided in the electric circuit (X02) used in the first aspect of the invention.

12 Claims, 5 Drawing Sheets

FIG. 2
(PRIOR ART)
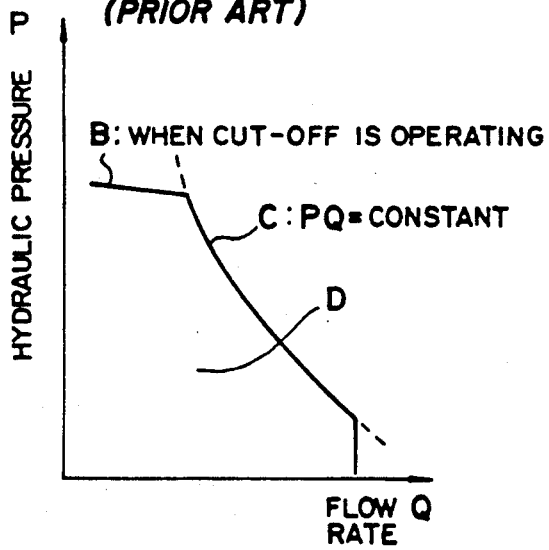
FIG. 3
(PRIOR ART)
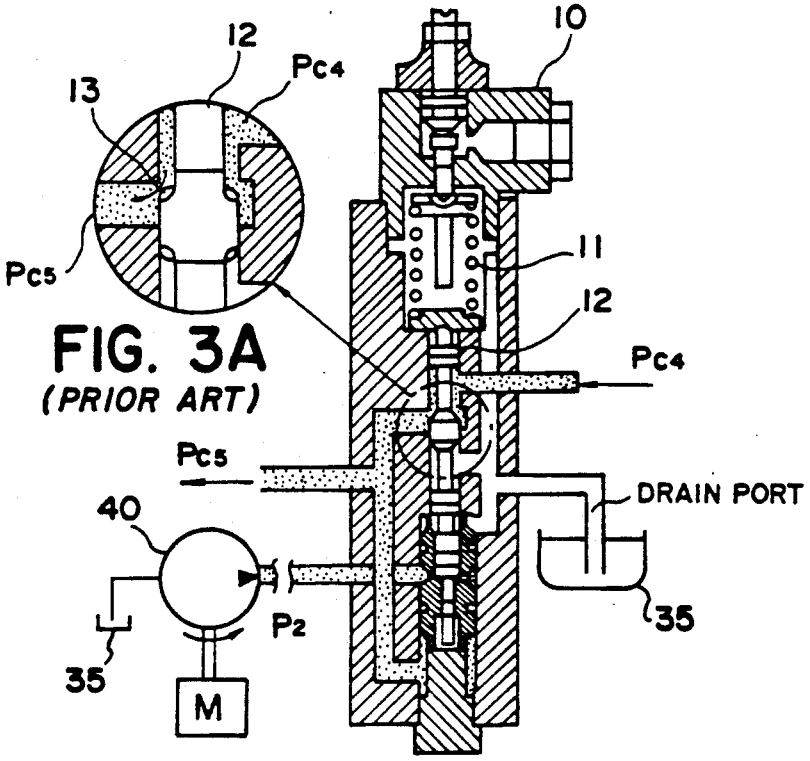
FIG. 3A
(PRIOR ART)

FIG. 7 (X02)
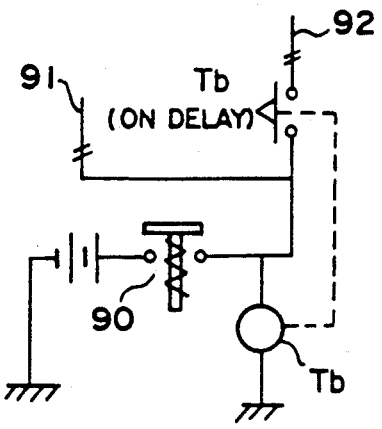

CONSTANT POWER DISPLACEMENT CONTROL CUTOFF SYSTEM WITH ADJUSTABLE RELIEF VALVE

BACKGROUND OF THE INVENTION

The present invention relates to a hydraulic control system for a hydraulic excavator, and more particularly to a hydraulic control system for a hydraulic excavator which allows operating power and operating speed to be improved as necessary.

Generally, a hydraulic excavator comprises a lower traveling body and a revolving superstructure. The revolving superstructure has an operating machine provided with a boom, an arm, a bucket, and the like. The traveling apparatus, the revolving apparatus, the operating machine, and other apparatus used in a hydraulic excavator are operated by hydraulic actuators that are separately provided therein. In other words, various hydraulic circuits are mounted on a hydraulic excavator. Generally, such hydraulic circuits comprise a main circuit and a pilot circuit. The main circuit includes a hydraulic actuator, a flow-rate control valve, a hydraulic control valve, a direction changeover valve, a servo valve, and other hydraulic devices. The pilot circuit is adapted to provide instructions to the flow-rate control valve, the hydraulic control valve, the direction changeover valve, the servo valve, etc. so that they operate as required. As a pilot system this pilot circuit comprises hydraulic pressure, pneumatic pressure, electrical signals, means for combining them, and other means. Accordingly, so-called hydraulic control circuits generally represent the flow-rate control valve, hydraulic control valve, direction changeover valve, servo valve, etc. of the main circuit, as well as pilot circuits related to them. These pilot circuits control the amount of oil supplied to the hydraulic actuator of the main circuit and the oil pressure thereof.

It has in recent years become the practice to control such a hydraulic control circuit of a hydraulic excavator in such a manner that the hydraulic horsepower is constantly set at a fixed level (hereafter, this control will be referred to as power constant control). This power constant control is conducted with a view to causing the hydraulic horsepower to coincide with the engine output to as practical an extent as possible. By virtue of this control, overall output losses can be reduced. A more advanced type of hydraulic control circuit is generally so arranged as to limit the power constant control when the pressure of the main circuit approaches relief pressure (hereafter, this control will be referred to as cut-off control). Incidentally, the aforementioned relief pressure refers to the maximum hydraulic pressure of the main circuit. When the actuator is subjected to a heavy load or the like, the hydraulic pressure of the main circuit rises, and the relief pressure is provided to limit the extent of this rise in pressure so as to protect the circuit and its component devices from becoming damaged by the hydraulic pressure. This relief pressure is set by the hydraulic control valve (hereafter referred to as the relief valve). Returning to the cut-off control, this control is also designed to reduce output losses. More specifically, when the pressure of the main circuit approaches the relief pressure, the flow rate decreases on the basis of the power constant control. Since the flow rate is still high, this cut-off control is effected to further reduce the flow rate sharply. If this cut-off control is not provided, a large amount of oil would return to the oil sump when the circuit pressure is close to the relief pressure. At this time, output loss would occur due to the rise in oil temperature and the occurrence of relief noise.

Referring now to FIGS. 1 to 3 which illustrate an example of a conventional hydraulic control apparatus for a hydraulic excavator having the above-described arrangement, a detailed explanation will be given of the hydraulic control apparatus. The hydraulic circuit shown in FIG. 1 is an example of a generally adopted hydraulic circuit of this type. It goes without saying that this circuit is provided with a power constant control valve 30 and a cut-off control valve 10. In addition, this hydraulic circuit is composed of main circuits P and pilot circuits Pc. The main circuit P (the relevant circuits and the associated hydraulic pressure levels are denoted by the same reference character) includes a hydraulic tank 35, a variable capacity-type hydraulic pump 40, a changeover valve 41, various actuators 42*n*, a relief valve 60, and circuits connecting them.

A description will now be given of the flow of oil. Oil from the hydraulic tank 35 is supplied to the changeover valve 41 via the variable capacity-type pump 40. Here, the oil is either returned to the tank 35 or supplied to the actuators 42*n* so as to actuate the same. As described above, the relief valve 60 limits the relief pressure of the main circuit.

The pilot circuit Pc comprises a constant capacity-type hydraulic pump 50, and a servo valve 20, a cut-off control valve 10, a power constant control valve 30, which constitute a hydraulic control system, as well as circuits P1, P2, P3, Pc1, Pc2, Pc3, Pc4, and Pc5 which connect them.

A description will now be given of the relationships between the pilot circuit and the hydraulic control system. The pilot pressure Pc5 is supplied to the servo valve 20. If the pilot pressure Pc5 is large, the servo valve 20 controls the pilot pressure Pc2 in the direction in which the amount of oil discharged by the variable capacity-type hydraulic pump 40 increases. If the pilot pressure Pc5 is small, the servo valve 20 controls that pressure in the direction in which said amount of oil discharged decreases. This pilot pressure Pc2 acts on the variable capacity-type hydraulic pump 40 and controls the amount of oil discharged thereof, in the above-described manner.

A description will now be described of the power constant control valve 30 and the cut-off control valve 10. Upon receipt of the pilot pressure P3 from the main circuit P, the power constant control valve 30 controls the pilot pressure Pc4 and effects control in such a manner that the hydraulic horsepower remains constant (hydraulic pressure P $\times$flow rate Q=constant) (the results of this power constant control will be hereafter referred to as power constant characteristic C), as shown in FIG. 2. Meanwhile, upon receipt of the pilot pressure Pc4, the cut-off control valve 10 outputs the pilot pressure Pc5. In addition, the pilot pressure P2 from the main circuit is also input to the cut-off control valve 10. Normally (when the main circuit is not set under the relief pressure), the pilot pressure Pc4 (one in which the pilot pressure Pc from the hydraulic pump 50 has been controlled through the circuits Pc1, Pc3, and the power constant control valve 30) is input to the cut-off control valve 10, which then outputs the pilot pressure Pc5 (the pressure being Pc4 Pc5) to the servo valve 20. However, when the hydraulic pressure P of the main circuit P approaches the relief pressure, the pilot pressure P2 (the pressure being P2 P), in cooperation with the pilot pressure Pc5 which is the self output pressure of the cut-off control valve 10, overcomes the force of the spring urged in the direction in which the cut-off control valve 10 is opened, thereby closing the cut-off control valve 10. The pilot pressure Pc4 is shut off through this operation. Consequently, the above-described power constant control is cut off. In other words, the power constant characteristics are canceled in the vicinity of the relief hydraulic pressure, as shown in FIG. 2. Hence, a cut-off characteristic B is obtained.

Since these cut-off characteristics B are essential to the description of the present invention, a specific arrangement of the cut-off control valve will be described on the basis of an example shown in FIGS. 3 and 3A. When the pilot pressure P2 from the main circuit is below the relief pressure, a spool 12 is pressed downward, as viewed in the drawing, by a spring 11. For this reason, the pilot pressure Pc4 is output as the pilot pressure Pc5. However, when the pilot pressure P2 from the main circuit approaches the relief pressure, the pilot pressure P2, in cooperation with the pilot pressure Pc5 which is the self output pressure of the cut-off control valve 10, overcomes the urging force of the spring 11, and thus pushes the spool 12 upwardly is viewed in the drawing, thereby gradually shutting off the output pilot pressure Pc5 through a notch 13 of the spool 12. It should be noted that the cut-off characteristic B has a slight inclination in FIG. 2 which is attributable to the effect of the notch 13 and the spring 11.

However, even with the hydraulic control system for a hydraulic excavator which has been well devised, as described above, in the case of an operation in a hydraulic region where the cut-off characteristic B can function readily (i.e., the region of a heavy load in which the relief pressure is liable to occur), the amount of oil declines immediately to a minimum amount with the slightest increase in hydraulic pressure, as can be seen from FIG. 2. In consequence, there is a drawback in that the speed of the actuator declines sharply. Furthermore, under the relief pressure, the operation of the actuator stops. Accordingly, in such a region of a head load, even if the operator desires to increase some more power and speed, the operator's desire cannot be attained. Hence, even with the hydraulic excavator which has thus been contrived well, the operator may disadvantageously determine that such a hydraulic excavator is a machine having a poor operating performance.

SUMMARY OF THE INVENTION

Accordingly, an object of the present invention is to provide a hydraulic control system for a hydraulic excavator which allows power and speed to be improved in a case where such an operating machine is tending to stop, thereby overcoming the above-described drawbacks of the conventional art.

To this end, in accordance with one aspect of the present invention, a hydraulic control system for a hydraulic excavator having "power constant control" and "cut-off control" comprises: variable relief valve (60A) which, upon receipt of a pilot signal (Pc7), allows the relief pressure to rise; a solenoid valve (80) for connecting and disconnecting the pilot signal (Pc7); a variable cut-off control valve 10A which, upon receipt of a pilot signal (Pc6), cancels the cut-off control; a solenoid valve (70) for connecting or disconnecting the pilot signal (Pc6); and an electric circuit in which the solenoid valves (70, 80) are connected in parallel with each other and a switch (90) therefor is provided, whereby the relief pressure and the amount of oil are increased while the switch (90) is operated to be closed.

By virtue of the above-described arrangement, it is possible to increase the relief pressure and the amount of oil while the switch 90 is closed (ON).

In accordance with another aspect of the present invention, there is provided a hydraulic control for a hydraulic excavator wherein the electric circuit is provided with a timer.

By virtue of this arrangement, it is possible to control a difference in response between a rise in the relief pressure and an increase in the amount of oil. In other words, it becomes possible to prevent in advance any occurrence of the trouble of the hydraulic devices becoming damaged due to a sharp increase in the relief pressure.

BRIEF DESCRIPTION OF THE DRAWINGS

FIG. 2 is a graph illustrating the characteristics of the conventional hydraulic control system;

FIG. 3 is a cross-sectional view of a cut-off control valve;

FIG. 3A is an enlargement of a portion of FIG. 3;

FIG. 7 is a diagram illustrating an embodiment in accordance with the second aspect of the invention.

DESCRIPTION OF THE PREFERRED EMBODIMENTS

Figure 1:
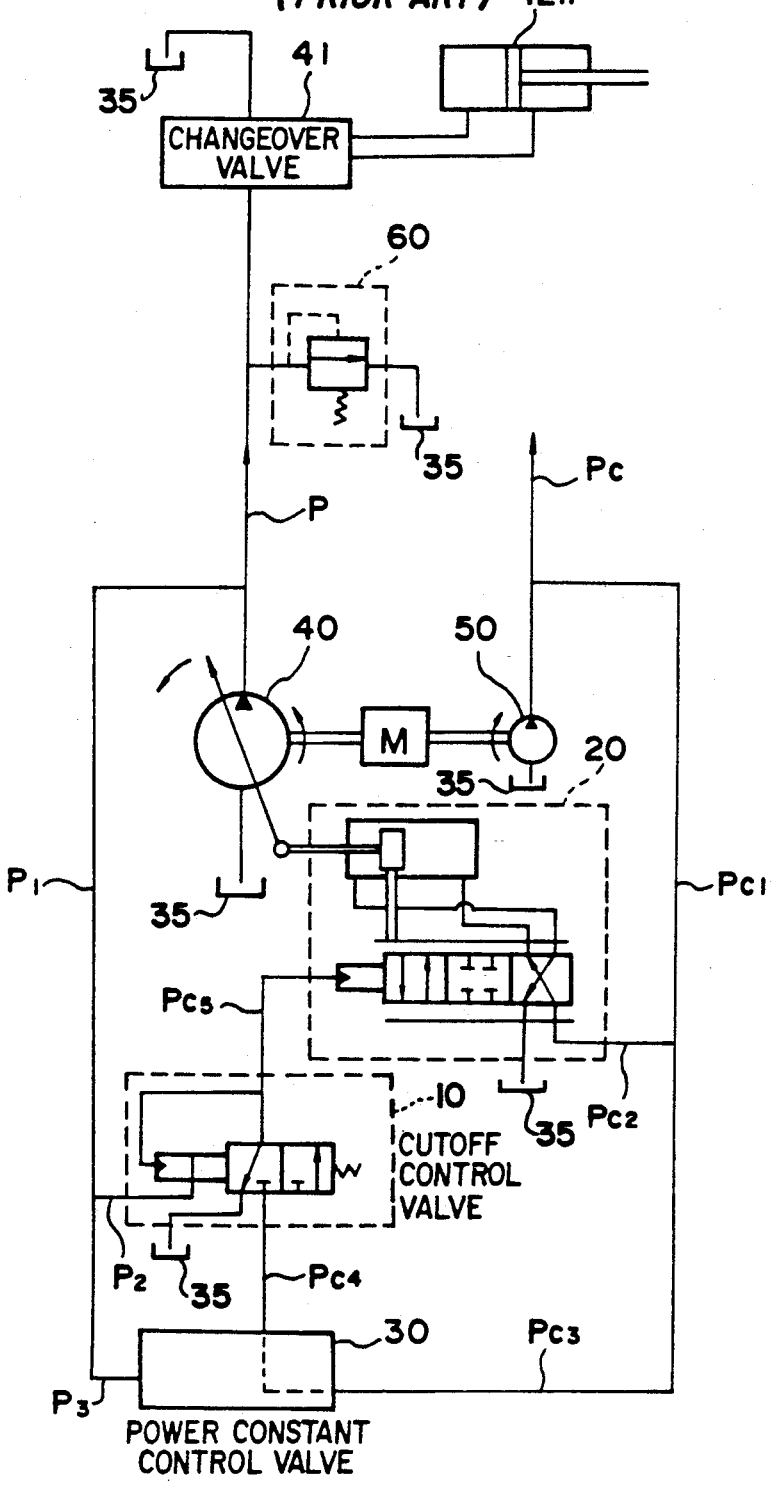
FIG. 1 (PRIOR ART)
FIG. 1 is a hydraulic circuit diagram of a conventional hydraulic excavator.
Figure 4:
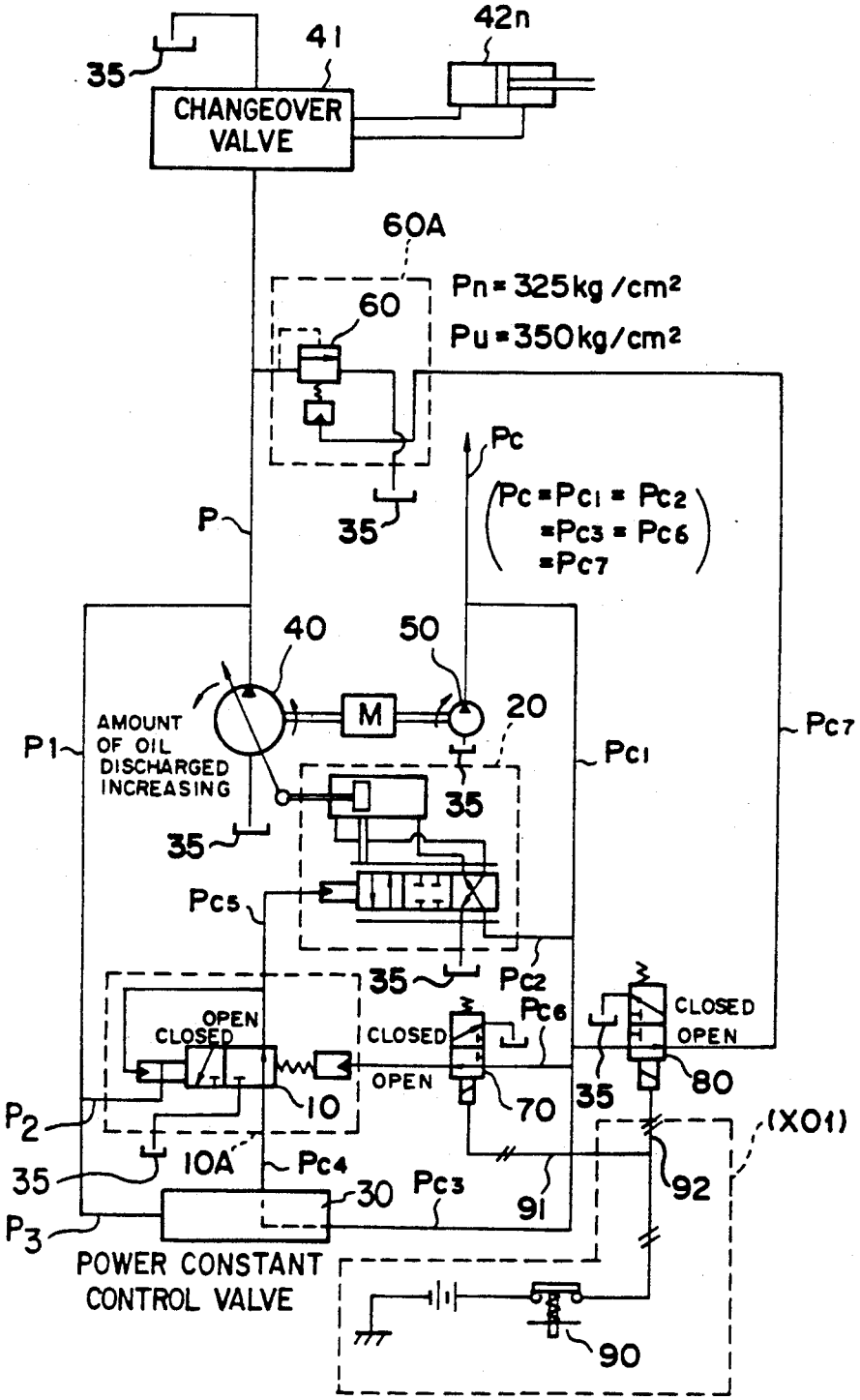
FIG. 4 is a hydraulic circuit diagram incorporating an embodiment of a hydraulic control system in accordance with a first aspect of the invention.

FIG. 4 is a diagram illustrating an embodiment in accordance with a first aspect of the present invention. Specifically, FIG. 4 is a hydraulic circuit diagram of a hydraulic excavator in which the embodiment is incorporated. FIG. 1 referred to in the background of the invention is used as it is in FIG. 4, in which the embodiment is added. Accordingly, the explanation given with reference to FIGS. 2 and 3 used in the description of the background of the invention can also apply correspondingly to this embodiment. For this reason, the arrangement, operation, and advantages which have already been described in the background of the invention are omitted as practically as possible, to avoid a redundant explanation. Incidentally, hydraulic pressure, pneumatic pressure, or the like can be used as the pilot signal, as described above, but in this embodiment a hydraulic pilot signal is used.

A description will now be given of the embodiment. Component elements that are used in this embodiment and differ from the conventional example will be clarified first. That is, in FIG. 4, the component elements of the present invention that have been added or altered with respect to the conventional arrangement shown in FIG. 1, as well as their functions, are as follows:

(1) Pilot pressures (since the pilot type is hydraulic pressure in this embodiment, all the pilot signals will be referred to as the pilot pressure) Pc6, Pc7—The pilot pressure Pc6 constitutes a pressure signal introduced from a pilot circuit Pc6 which is communicatingly changed over by a solenoid valve 70 (to be described later) and leads to a variable cut-off control valve 10A (to be described later). Meanwhile, the pilot pressure Pc7 constitutes a pressure signal introduced from a pilot circuit Pc7 which is communicatingly changed over by a solenoid valve 80 (to be described later) and leads to a variable relief valve 60A (to be described later). These are pressure signals and pilot circuits which have been newly added for the present invention.

(2) Variable relief valve 60A adapted to increase the relief pressure upon receipt of the pilot pressure Pc7—This variable relief valve 60A is arranged such that, in the conventional relief valve 60, the pilot pressure Pc7 is introduced to an urging spring which restricts the relief pressure, thereby making the urging force of the spring variable. Accordingly, this variable relief valve 60A is arranged such that the conventional relief valve 60 is partially modified for the present invention. To describe the operation of this variable relief valve 60A, when the pilot pressure Pc7 is applied to the urging spring of the variable relief valve 60, the urging force of the spring increases. That is, the relief pressure rises. In this embodiment, two-stage relief pressure (325 kg/cm$^2$ and 350 kg/cm$^2$) is attained due to the presence or absence of the pilot pressure Pc7.

(3) Solenoid valve 80 for connecting or disconnecting the pilot pressure Pc7—This is a 3-port, 2-position solenoid valve which is newly added to the pilot circuit Pc7 for the resent invention.

Figure 5:
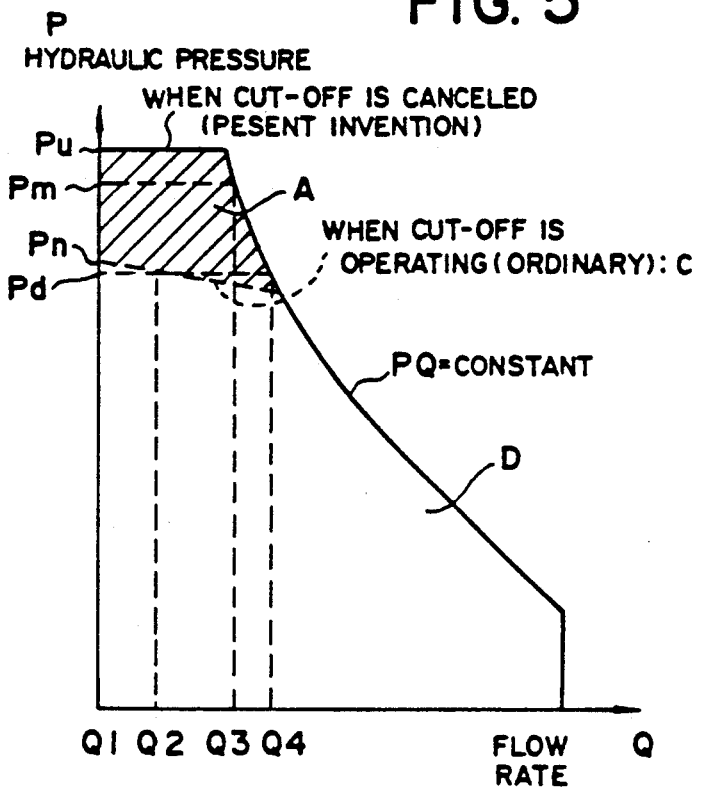
FIG. 5 is a graph illustrating the characteristics of the hydraulic control system in accordance with the first aspect of the invention.

(4) Variable cut-off control valve 10A to which the pilot pressure Pc6 is input to cancel the cut-off control—This variable cut-off control valve 10A is arranged such that, in the conventional cut-off control valve 10, the pilot pressure Pc6 is introduced to the urging spring that restricts a cut-off point, thereby making the urging force of the spring variable. Accordingly, this variable cut-off control valve 10A is arranged such that the conventional cut-off control valve 10 is partially modified for the sake of the present invention. A description will now be given of the operation of the variable cut-off control valve 10A. When the pilot pressure Pc6 is applied to the urging spring of the variable cut-off control valve 10A, the urging force of the spring increases. That is, the cut-off point is set to the high-pressure side. Consequently, a power control characteristic C (see FIG. 2) is maintained to the higher-pressure side (see FIG. 5).

(5) Solenoid valve 70 for connecting or disconnecting the pilot pressure Pc6—This is a 3-port, 2-position solenoid valve which is newly added to the pilot circuit Pc6 for the sake of the present invention.

(6) Electric circuit (X01) in which the solenoid valves 70, 80 are connected in parallel to each other and an opening/closing switch 90 therefor is provided—This circuit is newly provided for the sake of the present invention. This normally open switch 90 is a button push-in type, and when it is turned ON, the voltage is applied to the solenoid valves 70, 80 to set the solenoid valves 70, 80 in the open positions.

Next, a description will be given of the operation of this embodiment comprising the above-described components (1) to (6). If the switch 90 is turned ON as illustrated in FIG. 4, the solenoid valves 70, 80 are set to open positions. As a result, the pilot pressure Pcl acts on the variable relief valve 60A via the solenoid valve 80 and the pilot circuit Pc7. The pilot pressure Pc7 increases the urging force of the spring of the variable relief valve 60A, and increases the relief pressure from 325 kg/cm$^2$ to 350 kg/cm$^2$. Meanwhile, the pilot pressure Pc1 acts on the urging force of the spring of the cut-off control valve 10A via the pilot circuit Pc6 and the solenoid valve 70 to maintain the power constant characteristic C to the new relief pressure side. This is shown by a hydraulic horsepower diagram shown in FIG. 5 it becomes possible to make extra use of the hydraulic horsepower in the region A indicated by slanting lines. Conversely, if the hand lets go of the switch 90, the switch 90 is turned OFF. In this case, the above-described operation is canceled immediately, the performance returns to the same performance as the conventional one (unhatched region D in FIG. 5). Accordingly, while the switch 90 is turned ON, it is possible to obtain extra hydraulic horsepower of region A.

Referring again to FIG. 5, a description will be given of the advantages of this embodiment. For instance, when the main circuit pressure is Pd, the flow-rate of the main circuit obtained in the conventional arrangement is Q2, but, in the arrangement of this embodiment, it is possible to obtain a flow rate Q4 in which Q4>Q2. When the main circuit pressure is Pm (Pm>Pd), with the conventional arrangement, since the hydraulic pressure Pm is not present, the main circuit pressure becomes Pn, and only Q1 is obtained as the flow rate of the main circuit. With the arrangement of this embodiment, however, in this case it is possible to obtain a flow rate Q3 in which Q3>Q1. In other words, during the operation under a heavy load in which the operating machine is tending to stop, if the operator desires to have some more power and speed, this desire cannot be attained with the conventional arrangement. In accordance with this embodiment, however, the power and speed can be obtained by simply pressing the switch 90.

Figure 6:
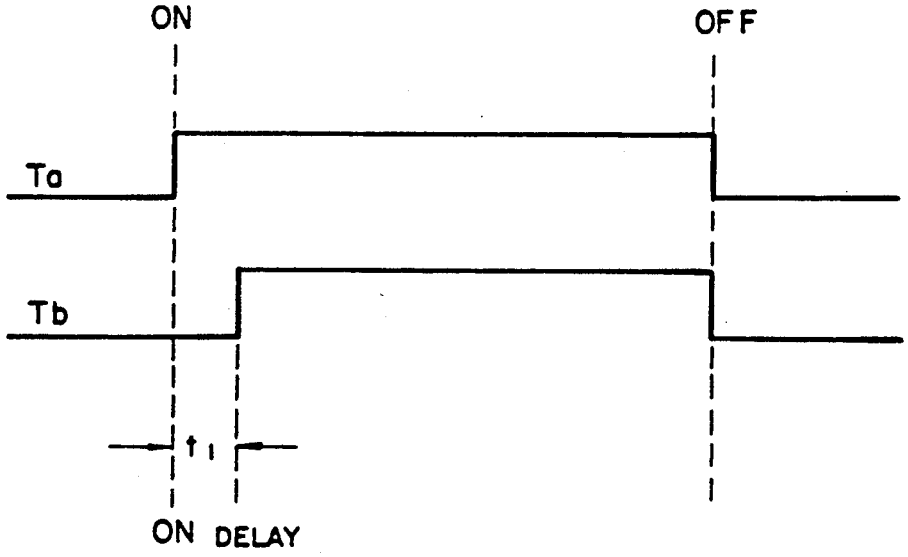
FIG. 6 is a time chart of a timer in accordance with a second aspect of the invention.

Next, a description will be given of an embodiment in accordance with a second aspect of the present invention. In this embodiment, a timer is used for the electric circuit (X01) shown in the above-described embodiment in accordance with the first aspect of the invention. In the arrangement of the first aspect alone, if the switch 90 is pressed, the two solenoid valves 70, 80 are actuated simultaneously. Dynamically speaking, however, there are cases where the pressure is boosted by the variable relief valve 60A before the cut-off control is canceled. In such a case, the relief pressure is boosted first. Consequently, there are apprehensions that damage may be caused to the cut-off control valve 10A and other hydraulic devices. Accordingly, in the second aspect of the invention, an arrangement is provided such that the variable cut-off control valve 10A can be operated in advance of the variable relief valve 60A so as to eliminate such apprehensions. A timer which is suitable for this function will be described with reference to FIG. 6. As a timer Tb for the variable relief valve 60A, a time lagged-type timer is desirable when the switch 90 is ON.

FIG. 7 is a diagram illustrating an embodiment (X02). This is an embodiment in which the timer Tb, for performing a delaying operation when the switch 90 is turned on, is mounted in the electric circuit 92.

It should be noted that the present invention is not restricted to the illustrated and described embodiments alone, and it goes without saying that, if conventional hydraulic excavators of various types meet the logic of the features of the prior art described herein, the system in accordance with the present invention can be mounted on such hydraulic excavators of various types within the scope of its claims.

As described above, the hydraulic control system for a hydraulic excavator in accordance with the present invention is particularly suited to a hydraulic excavator for which heavy-load operations are required.

What is claimed is:

1. A hydraulic control system for a hydraulic excavator in which power constant control is effected in such a manner that hydraulic horsepower remains constant, and, when the hydraulic pressure of the hydraulic fluid in the main circuit reaches the vicinity of the relief pressure, cut-off control is effected in such a manner that said power constant control is cut off, said hydraulic control system comprising:

a variable relief valve (60A) which, upon receipt of a first pilot signal (Pc7), allows the relief pressure to rise;

a first solenoid valve (80) for connecting and disconnecting said first pilot signal (Pc7) and said variable relief valve (60A);

a variable cut-off control valve (10A) which, upon receipt of a second pilot signal (Pc6), cancels the cut-off of said power constant control;

a second solenoid valve (70) for connecting or disconnecting said second pilot signal (Pc6) and said variable cut-off control valve (10A); and an electric circuit (X01 or X02) in which said first and second solenoid valves (70, 80) are connected in parallel with each other and a switch (90) therefor is provided, said switch having at least a first position and a second position, whereby the relief pressure and the amount of hydraulic fluid are increased while said switch (90) is operated to said first position.

2. A hydraulic control system for a hydraulic excavator according to claim 1, wherein said electric circuit (X02) is provided with a timer (Tb).

3. A hydraulic control circuit for hydraulic equipment operated by a hydraulic circuit, comprising a source of pressurized hydraulic fluid, a discharge rate control unit for varying the discharge rate of pressurized fluid from said source responsive to an input signal, at least one hydraulic actuator, a main circuit conduit to supply pressurized hydraulic fluid from said source to said at least one hydraulic actuator, a pressure relief valve connected to said main circuit conduit to relieve the pressure in said main circuit conduit when the pressure in said main circuit conduit exceeds a first set value, a power constant control unit which produces a first control signal responsive to the pressure in said main circuit conduit to vary the rate of discharge of hydraulic fluid from said source to maintain the hydraulic horsepower of the pressurized hydraulic fluid discharged from said source at a predetermined level, a cut-off control unit which normally passes said first control signal to said discharge rate control unit as said input signal except when the pressure in said main circuit conduit is above a second set value which is less than said first set value, a first pilot line to apply a first pilot signal to said pressure relief valve to thereby vary the value of said first set value, and a second pilot line to apply a second pilot signal to said cut-off control unit to thereby vary the value of said second set value.

4. A hydraulic control circuit in accordance with claim 3, further comprising means for controlling the passage of said first pilot signal through said first pilot line to said pressure relief valve, and means for controlling the passage of said second pilot signal through said second pilot line to said cut-off control unit.

5. A hydraulic control circuit in accordance with claim 3, further comprising a first pilot valve in said first pilot line and a second pilot valve in said second pilot line.

6. A hydraulic control circuit in accordance with claim 5, wherein each of said first and second pilot valves has a first position permitting passage of the respective pilot signal therethrough and a second position preventing passage of the respective pilot signal therethrough.

7. A hydraulic control circuit in accordance with claim 6, wherein the passage of the first pilot signal to said pressure relief valve increases the value of said first set value.

8. A hydraulic control circuit in accordance with claim 7, wherein the passage of the second pilot signal to said cut-off control unit prevents the cut-off control unit from blocking the passage of the first control signal to the discharge rate control unit.

9. A hydraulic control circuit in accordance with claim 8, wherein said first and second pilot valves are solenoid valves, and further comprising an electrical circuit to actuate said solenoid valves, said electrical circuit containing a switch which is manually actuatable by an operator of the hydraulic equipment to cause said first and second pilot valves to move from their second positions to their first positions.

10. A hydraulic control circuit in accordance with claim 9, wherein said electrical circuit further comprises a timer, which is energized by the actuation of said switch by the operator, to delay the actuation of said first pilot valve.

11. A hydraulic control circuit in accordance with claim 10, wherein said source comprises a variable capacity hydraulic pump and wherein said discharge rate control unit comprises a servo valve.

12. A hydraulic control circuit in accordance with claim 11, further comprising a constant capacity hydraulic pump to provide said first and second pilot signals, and a motor driving both of said pumps.

* * * * *

UNITED STATES PATENT AND TRADEMARK OFFICE

CERTIFICATE OF CORRECTION

PATENT NO. : 5,077,974

DATED : January 7, 1992

INVENTOR(S) : Nobuhisa Kamikawa and Kimio Nishida

It is certified that error appears in the above-identified patent and that said Letters Patent is hereby corrected as shown below:

On title page, item [73], change the Assignee's name, "Kabushiki Kaisha Komatsu Setsakusho", to --Kabushiki Kaisha Komatsu Seisakusho--.

Signed and Sealed this

Thirteenth Day of July, 1993

*Attest:*

Michael K. Kirk

MICHAEL K. KIRK

*Attesting Officer*

*Acting Commissioner of Patents and Trademarks*